US009828994B2

(12) United States Patent
Kakuda et al.

(10) Patent No.: US 9,828,994 B2
(45) Date of Patent: Nov. 28, 2017

(54) SCROLL COMPRESSOR HAVING A SCROLL WRAP WITH TIERED INNER END

(71) Applicant: Mitsubishi Electric Corporation, Tokyo (JP)

(72) Inventors: Masayuki Kakuda, Tokyo (JP); Kohei Tatsuwaki, Tokyo (JP); Masaya Okamoto, Tokyo (JP); Koichi Fukuhara, Tokyo (JP); Fumihiko Ishizono, Tokyo (JP); Masaaki Sugawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/899,320

(22) PCT Filed: Sep. 19, 2013

(86) PCT No.: PCT/JP2013/075341
§ 371 (c)(1),
(2) Date: Dec. 17, 2015

(87) PCT Pub. No.: WO2015/040720
PCT Pub. Date: Mar. 26, 2015

(65) Prior Publication Data

US 2016/0131134 A1 May 12, 2016

(51) Int. Cl.
*F03C 2/00* (2006.01)
*F03C 4/00* (2006.01)
(Continued)

(52) U.S. Cl.
CPC ..... *F04C 18/0269* (2013.01); *F01C 1/0246* (2013.01); *F01C 1/0269* (2013.01);
(Continued)

(58) Field of Classification Search
CPC ..... F04C 18/0215; F04C 18/0246; F04C 18/0269; F04C 18/0276; F04C 18/0284;
(Continued)

(56) References Cited

U.S. PATENT DOCUMENTS 5,370,512 A * 12/1994 Fujitani ..... F04C 18/0269 418/55.2
5,765,999 A * 6/1998 Ito ..... F04C 18/0246 418/55.2
(Continued)

FOREIGN PATENT DOCUMENTS

JP 01216091 A * 8/1989 ..... F04C 18/0269
JP 03145585 A * 6/1991 ..... F04C 18/0269
(Continued)

OTHER PUBLICATIONS

Office Action dated Sep. 5, 2016 issued in corresponding CN patent application No. 201380078567.4 (and English translation).
(Continued)

*Primary Examiner* — Theresa Trieu
(74) *Attorney, Agent, or Firm* — Posz Law Group, PLC

(57) ABSTRACT

A scroll compressor to compress fluid in a compression chamber formed by combining a scroll wrap of a fixed scroll and a scroll wrap of an orbiting scroll, the scroll wrap of the fixed scroll and the scroll wrap of the orbiting scroll each having a scroll inner end part having a bulb shape defined by an outer surface involute curve, an inner surface involute curve, and a plurality of arcs connecting an end of the outer surface involute curve and an end of the inner surface involute curve, at least one of the scroll inner end parts being formed in an n-tier stair-like shape in which n (n≥3) number of bulb shapes are stacked on top of one another in an upright direction of the scroll wrap, the scroll compressor being configured to satisfy $\phi os(0) > \phi os(1) > \phi os(2) > \ldots > \phi os(n-1)$ where involute roll angles of the outer surface
(Continued)

involute curve in tiers of the stair-like shape of the scroll inner end part are φos (0), φos (1), φos (2), . . . , φos (n−1), respectively, from a wrap tip side to a wrap root side.

5 Claims, 13 Drawing Sheets

(51) Int. Cl.

| | |
|---|---|
| ***F04C 2/00*** | (2006.01) |
| ***F04C 18/02*** | (2006.01) |
| ***F01C 1/02*** | (2006.01) |
| *F04C 23/00* | (2006.01) |
| *F04C 29/12* | (2006.01) |

(52) U.S. Cl.
CPC ..... *F01C 1/0284* (2013.01); *F04C 18/0215* (2013.01); *F04C 18/0276* (2013.01); *F04C 18/0284* (2013.01); *F04C 23/008* (2013.01); *F04C 29/12* (2013.01)

(58) Field of Classification Search
CPC .... F01C 1/0215; F01C 1/0246; F01C 1/0269; F01C 1/0276; F01C 1/0284
USPC ..... 418/55.1–55.6, 57
See application file for complete search history.

(56) References Cited

U.S. PATENT DOCUMENTS

| | | | | |
|---|---|---|---|---|
| 6,478,557 | B2 * | 11/2002 | Shiibayashi | F04C 18/0269 418/55.2 |
| 6,499,978 | B2 * | 12/2002 | Cho | F04C 18/0269 418/55.2 |
| 7,244,114 | B2 * | 7/2007 | Hiwata | F04C 18/0269 418/55.2 |

FOREIGN PATENT DOCUMENTS

| | | | | |
|---|---|---|---|---|
| JP | H03-264789 | A | 11/1991 | |
| JP | H09-068177 | A | 3/1997 | |
| JP | 2003-049785 | A | 2/2003 | |
| JP | 2004-076629 | A | 3/2004 | |
| JP | 2006-257941 | A | 9/2006 | |
| JP | 20131221 7 | * | 6/2013 | F04C 18/0269 |

OTHER PUBLICATIONS

International Search Report of the International Searching Authority dated Dec. 17, 2013 for the corresponding international application No. PCT/JP2013/075341 (and English translation).
Extended European Search Report dated Feb. 13, 2017 issued in corresponding EP patent application No. 13 893 886.5.

* cited by examiner

SUCTION COMPLETION (0deg)

90deg

180deg

270deg

START OF COMMUNICATION(ψq)

ψq+15deg

ψq+30deg

ψq+45deg

SCROLL COMPRESSOR HAVING A SCROLL WRAP WITH TIERED INNER END

TECHNICAL FIELD

The present invention relates to a scroll compressor used for freezing or air conditioning. More specifically, the present invention relates to a scroll compressor suitable for application, for example, air conditioning, in which a wide range of compression ratio may be required of compressors.

BACKGROUND ART

A scroll compressor has a predetermined internal volume ratio depending on the specifications of its scroll wraps. Where the operating condition yields a proper compression ratio for the internal volume ratio, no inappropriate compression loss will result. However, an inappropriate compression loss is caused under an operating condition that yields a lower compression ratio than the proper compression ratio. This is called an over-compression loss. Another inappropriate compression loss is caused under an operating condition in which the compression ratio is a higher than the compression ratio. This is called an insufficient compression loss. Usually, the effect of inappropriate compression loss is reduced by selecting a specification of scroll wrap such that the scroll wrap has an internal volume ratio tailored to an operating condition most prioritized in view of various conditions such as the rated condition and the operation frequency.

To suppress over-compression loss, reducing the flow path resistance in discharge pathways is effective. The discharge pathways refer to those in which gas is discharged after compression from the compression chamber (innermost chamber) in the scroll wrap center. To suppress insufficient compression loss, reducing a so-called the dead volume is effective. The dead volume is the volume of the innermost chamber on communicating with the second chamber when the compression is completed. The dead volume depends on the internal volume ratio. Some conventional techniques have minimized the volume of the innermost chamber while securing the strength of the center part of the scroll wrap to reduce insufficient compression loss (see, for example, Patent Literature 1).

CITATION LIST

Patent Literature

Patent Literature 1: Japanese Unexamined Patent Application Publication No. 9-68177

SUMMARY OF INVENTION

Technical Problem

In a scroll compressor of Patent Literature 1, the sectional shape of the center part of the scroll wrap is formed in a stair-like shape, the center shape of the scroll wrap in each tier has a "complete engagement profile" in which the volume of the innermost chamber is substantially zero, that is, so-called "no bulb shape", and a tier has a smaller wrap thickness than tiers lower than it. The upper tier here is more distant from the baseplate than the lower one. Patent Literature 1 describes that insufficient compression loss can be thereby reduced while securing the strength of the scroll wrap.

Although such employment of the bulb shape is effective in reducing re-expansion loss in insufficient compression, it causes, in over-compression, narrowing the discharge flow path from the second chamber after the communication is established. Moreover, the elimination of the bulb shape is often counterproductive to reducing over-compression loss.

Ways to avoid such an adverse effect include setting the internal volume ratio as small as possible to widen the operating range in which benefit of unemployment of the bulb shape is obtained. In this case, insufficient compression is caused rather than causing over-compression. However, there in another concern in an effort to follow the trend of focusing on partial load performance in recent air conditioners. That is, pressure rising in the "complete engagement" part after the communication will be the main part of compression rather than in the scroll wrap part. This is caused under a condition of a significantly small internal volume ratio setting and a relatively high compression ratio, and leads to an increase of torque pulsation.

The present invention is made to overcome the above-described problems, and an object of the present invention is to provide a scroll compressor in which the effect of inappropriate compression loss can be reduced under a wide operating condition.

Solution to Problem

The scroll compressor according to the present invention is a scroll compressor to compress fluid in a compression chamber formed by combining a scroll wrap of a fixed scroll and a scroll wrap of an orbiting scroll, the scroll wrap of the fixed scroll and the scroll wrap of the orbiting scroll each having a scroll inner end part having a bulb shape defined by an outer surface involute curve, an inner surface involute curve, and a plurality of arcs connecting an end of the outer surface involute curve and an end of the inner surface involute curve, at least one of the scroll inner end parts being formed in an n-tier stair-like (or tiered) shape in which n number of bulb shapes are stacked on top of one another in an upright direction of the scroll wrap, where the number n is equal to or larger than 3, the scroll compressor being configured to satisfy $\phi os(0) > \phi os(1) > \phi os(2) > \ldots > \phi os(n-1)$ where involute roll angles of the outer surface involute curve in tiers of the stair-like shape of the scroll inner end part are $\phi os(0), \phi os(1), \phi os(2), \ldots, \phi os(n-1)$, respectively, from a wrap tip side to a wrap root side.

Advantageous Effects of Invention

According to the present invention, the speed at which the communication path opens after the communication angle $\psi q$ between the innermost chamber and the second chamber determined by the involute roll angle of the outer surface involute curve in the uppermost tier can be adjusted over a wide range by the distribution of the height dimension among the respective tiers. This makes it possible to obtain a highly efficient scroll compressor in which the effect of inappropriate compression loss can be reduced under a wide operating condition from low compression ratio to high compression ratio.

DESCRIPTION OF EMBODIMENTS

Embodiment 1

Figure 1:
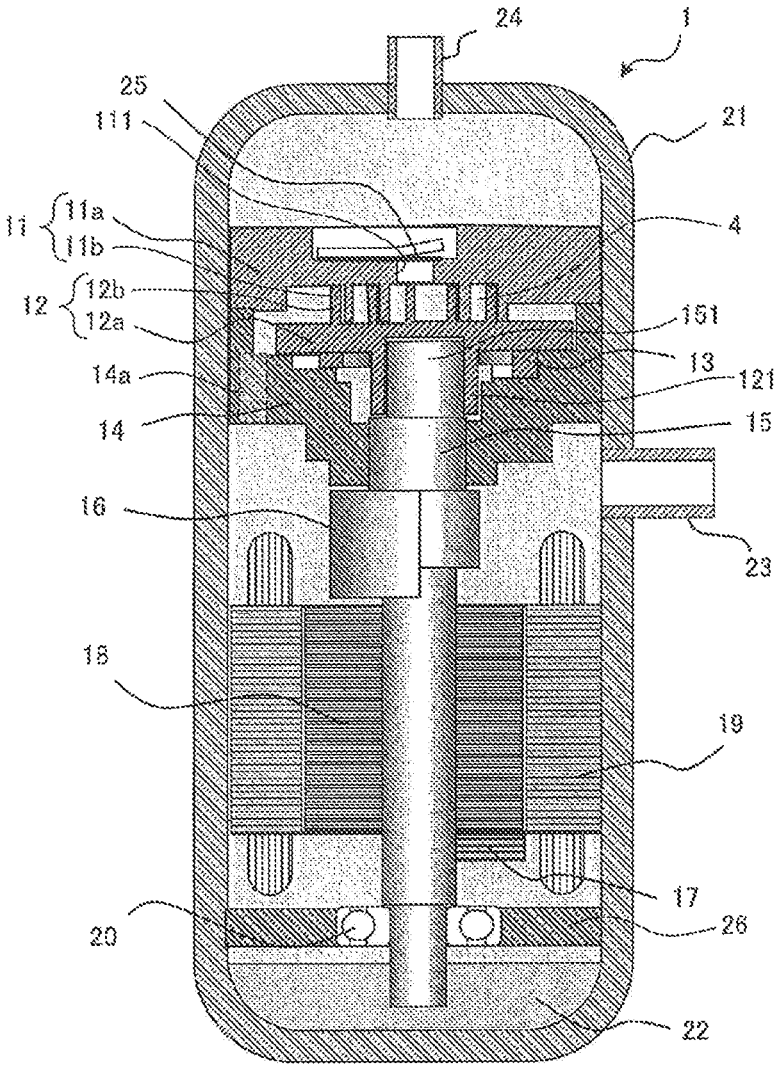
FIG. 1 is a schematic sectional view showing the structure of the scroll compressor 1 according to Embodiment 1 of the present invention.
Figure 2A:
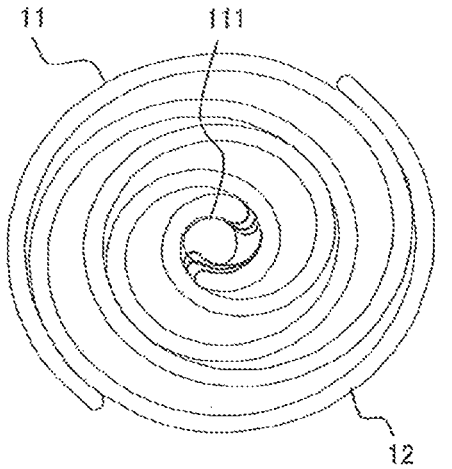
FIGS. 2(*a*), 2(*b*), 2(*c*) and 2(*d*) show the scroll wrap shapes of the fixed scroll 11 and the orbiting scroll 12 of the scroll compressor 1 according to Embodiment 1 of the present invention.
Figure 2B:
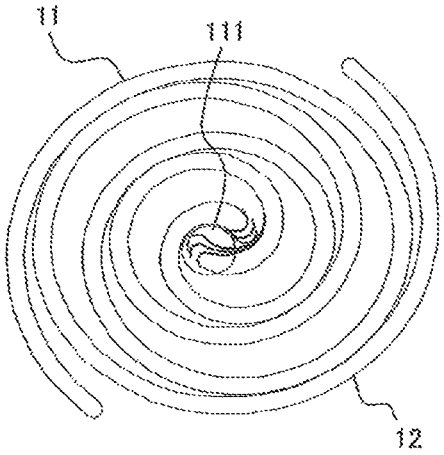
Figure 2C:
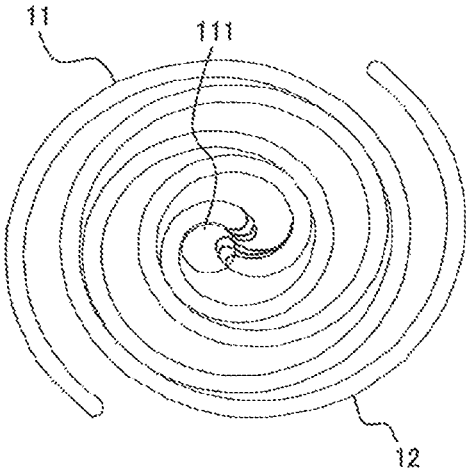
Figure 2D:
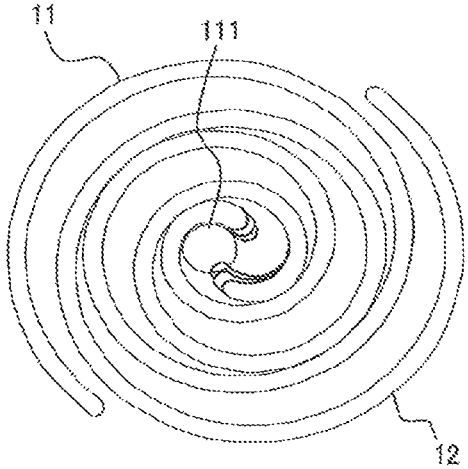

A scroll compressor according to Embodiment 1 of the present invention will be described. FIG. 1 is a schematic sectional view showing the structure of the scroll compressor 1 according to Embodiment 1. In the following drawings including FIG. 1, the size relationship, shapes, and the like of components are sometimes different from the actual ones. Further, in the following drawings including FIG. 1, elements denoted by the same reference signs are identical or equivalent, and this commonly applies to the entire description. In addition, the forms of components described in the entire description are merely illustrative and not restrictive.

As shown in FIG. 1, the scroll compressor 1 is used in refrigeration cycle apparatuses for freezing or air conditioning, such as refrigerators, freezers, vending machines, air-conditioning apparatuses, freezing apparatuses, and water heaters. For example, the scroll compressor 1 is used in refrigeration cycle apparatuses assumed to be operated in a wide compression ratio, such as refrigeration cycle apparatuses for air conditioning. This scroll compressor 1 sucks a fluid, such as refrigerant, that circulates through a refrigeration cycle, compresses it, and discharges it at high temperature and pressure.

The scroll compressor 1 has a configuration in which a fixed scroll 11, an orbiting scroll 12, an Oldham ring 13, a frame 14, a shaft 15, a first balancer 16, a second balancer 17, a rotor 18, a stator 19, a sub-frame 26, a sub-bearing 20, and a discharge valve 25 are housed in an airtight container 21. The bottom part of the airtight container 21 serves as an oil reservoir that stores lubricating oil 22. A suction pipe 23 for sucking the fluid and a discharge pipe 24 for discharging the fluid are connected to the airtight container 21. The suction pipe 23 is connected to part of the side surface of the airtight container 21, and the discharge pipe 24 is connected to part of the upper surface of the airtight container 21.

The fixed scroll 11 is fixed with bolts or the like (not shown) to the frame 14 that is fixed and supported in the airtight container 21. The fixed scroll 11 has an end plate 11*a*, and a scroll wrap 11*b* (blade) that is upright on one side of the end plate 11*a*. A discharge port 111 for discharging the compressed fluid is formed through the substantially central part of the fixed scroll 11. The discharge valve 25 is placed at the outlet of the discharge port 111 of the fixed scroll 11 so as to cover the discharge port 111, and prevents backflow of the fluid.

Owing to the Oldham ring 13, the orbiting scroll 12 orbits relative to the fixed scroll 11 without rotating. The orbiting scroll 12 has an end plate 12*a*, and a scroll wrap 12*b* (blade) that is upright on one side of the end plate 12*a*. A boss portion 121 having a hollow cylindrical shape is formed substantially in the center of the surface on the opposite side of the orbiting scroll 12 from the surface on which the scroll wrap 12*b* is formed. An orbiting bearing portion into which an eccentric portion 151 at the upper end of the shaft 15 to be described later is fitted (engaged) is provided inside the boss portion 121.

The fixed scroll 11 and the orbiting scroll 12 are fitted together such that the scroll wrap 11*b* and the scroll wrap 12*b* are engaged with each other, and are mounted in the airtight container 21. A compression chamber 4 the volume of which changes with the orbiting of the orbiting scroll 12 is formed between the scroll wrap 11*b* and the scroll wrap 12*b*.

The Oldham ring 13 is disposed on the thrust surface (the surface on the opposite side from the surface on which the scroll wrap is formed, and functions to prevent the rotation of the orbiting scroll 12. In other words, the Oldham ring 13 functions to prevent the rotation of the orbiting scroll 12 and to enable the orbiting scroll 12 to orbit.

The rotor 18 is fixed to the shaft 15, is rotationally driven by starting the application of current to the stator 19, and rotates the shaft 15. The second balancer 17 is attached to the lower surface of the rotor 18. The second balancer 17 rotates together with the rotor 18, and functions to mass-balance (statically and dynamically balance) this rotation. The second balancer 17 is attached to the rotor 18 with rivets or the like.

The stator 19 is disposed on the outer peripheral side of the rotor 18 at a predetermined interval, and rotationally drives the rotor 18 when the application of current is started. The outer peripheral surfaces of the stator 19 is fixed to and supported by the airtight container 21 by shrink fit or the like.

The shaft 15 is rotationally driven together with the rotor 18 by the application of current to the stator 19, and transmits this driving force to the orbiting scroll 12 attached to the eccentric portion 151. An oil supply path (not shown)

serving as a flow path for the lubricating oil 22 stored in the bottom part of the airtight container 21 is formed in the shaft 15.

The first balancer 16 is attached to a part of the shaft 15 that is located above the rotor 18. The first balancer 16 rotates together with the shaft 15, and functions to mass-balance (statically and dynamically balance) this rotation. The first balancer 16 is attached to the shaft 15 by shrink fit or the like.

The outer peripheral surface of the frame 14 is fixed to the inner peripheral surface of the airtight container 21 by shrink fit, welding, or the like, and the frame 14 is thereby attached. The frame 14 supports the fixed scroll 11, and rotatably supports the shaft 15 through a through-hole formed in the center. The frame 14 functions to orbitably support the orbiting scroll 12. A main bearing portion that rotatably supports the shaft 15 is provided in the through-hole of the frame 14. A suction port 14*a* that guides refrigerant gas existing in the space above the motor (rotor 18, stator 19) to the compression chamber 4 is formed in the frame 14.

The outer peripheral surface of the sub-frame 26 is fixed to the inner peripheral surface of the airtight container 21 by shrink fit, welding, or the like, and the sub-frame 26 is thereby attached. The sub-frame 26 rotatably supports the shaft 15 through a through-hole formed in the center. The sub-bearing 20 that rotatably supports the shaft 15 is provided in the through-hole of the sub-frame 26. The sub-frame 26 is placed in the lower part of the airtight container 21 so as to support the lower part of the shaft 15.

The operation of the scroll compressor 1 will be described briefly. When power is supplied to the stator 19, the rotor 18 generates torque, and the shaft 15 supported by the main bearing portion of the frame 14 and the sub-bearing 20 rotates. The orbiting scroll 12 the boss portion 121 of which is driven by the eccentric portion 151 of the shaft 15 is prevented from rotating by the Oldham ring 13 and orbits. The volume of the compression chamber 4 formed by the combination of the orbiting scroll with the scroll wrap 11*b* of the fixed scroll 11 is thereby changed.

Gaseous fluid sucked into the airtight container 21 through the suction pipe 23 with the orbiting of the orbiting scroll 12 is taken into the compression chamber 4 between the scroll wrap 11*b* of the fixed scroll 11 and the scroll wrap 12*b* of the orbiting scroll 12, and is compressed. The compressed fluid is discharged through the discharge port 111 provided in the fixed scroll 11 against the discharge valve 25, and is discharged through the discharge pipe 24 to the outside of the scroll compressor 1, that is, the refrigerant circuit.

The imbalance accompanying the movement of the orbiting scroll 12 and the Oldham ring 13 is balanced by the first balancer 16 and the second balancer 17. The lubricating oil 22 stored in the lower part of the airtight container 21 is supplied through the oil supply path provided in the shaft 15 to sliding parts (the main bearing portion, orbiting bearing portion, sub-bearing 20, thrust surface, and the like).

FIGS. 2(*a*)-2(*d*) show the scroll wrap shapes of the fixed scroll 11 and the orbiting scroll 12 of the scroll compressor 1. The internal volume ratio ρ of the scroll compressor 1 will be described with reference to FIGS. 2(*a*)-2(*d*). The details of the shape of the center part of the scroll wrap (scroll inner end part) will be described later. FIG. 2 (*a*) shows a state where the orbiting scroll 12 engaged with the fixed scroll 11 is located at a position of suction completion where the orbiting scroll 12 forms the outermost chamber. FIG. 2 (*b*) shows a state where the orbiting scroll 12 is located at a position rotated 90 deg. from the suction completion state of FIG. 2(*a*). FIG. 2 (*c*) shows a state where the orbiting scroll 12 is located at a position rotated 180 deg. from the suction completion state of FIG. 2(*a*). FIG. 2 (*d*) shows a state where the orbiting scroll 12 is located at a position rotated 270 deg. from the suction completion state of FIG. 2(*a*).

The orbiting scroll 12 performs orbiting movement, that is, revolving movement without rotation in the order of FIGS. 2(*a*), 2(*b*), 2(*c*), 2(*d*), and 2(*a*). Each compression chamber thereby decreases its volume. Accordingly, the sucked gaseous fluid is compressed and sequentially sent to the center, and is discharged from the innermost chamber through the discharge port 111 provided in the fixed scroll 11 to the outside of the scroll compressor 1.

The gaseous fluid is compressed by the decrease of the volume of the compression chamber during the period from when the suction into the outermost chamber is completed till when the second chamber communicates with the innermost chamber in the center, which is the period of about one revolution in the state shown in FIGS. 2(*a*)-2(*d*). When the volume of the outermost chamber when the suction is completed is denoted by stroke volume Vst, and the volume of the second chamber at the time of communication is denoted by Vd, Vst/Vd is the internal volume ratio ρ. When the compression ratio σ=Pd/Ps, the ratio of high pressure Pd to low pressure Ps of a refrigeration cycle is not a proper value for the internal volume ratio ρ, inappropriate compression loss due to over-compression or insufficient compression is caused. Improper compression loss is a type of loss illustrated on an indicator diagram (PV diagram) showing suction, compression, and discharge processes with pressure P as the ordinate and volume V as the abscissa (see FIGS. 3(*a*) and 3(*b*)).

Figure 3A:
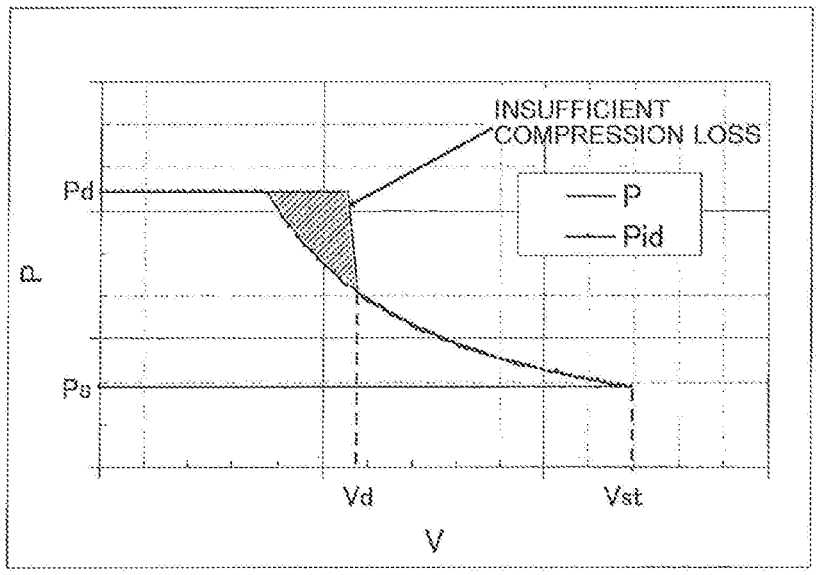
FIGS. 3(*a*) and 3(*b*) show an example of a PV diagram in the case of improper compression.
Figure 3B:
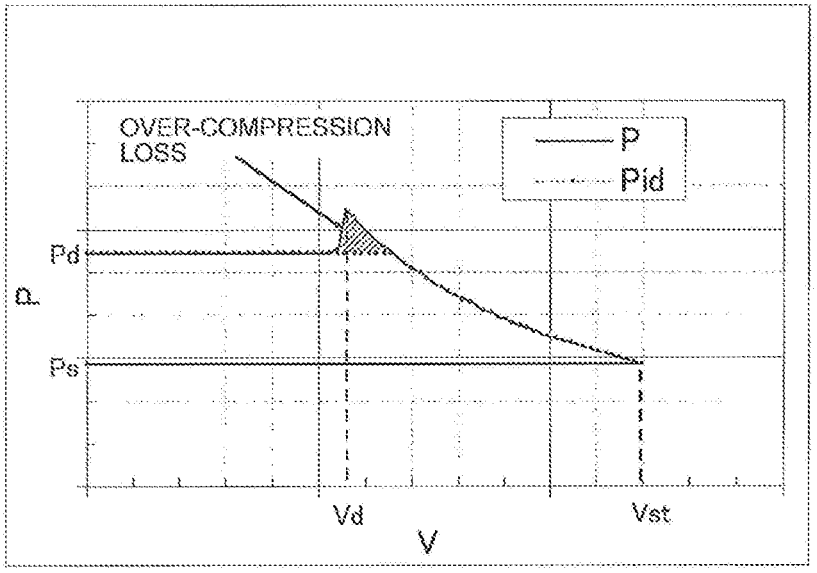

FIGS. 3(*a*) and 3(*b*) show an example of a PV diagram in the case of improper compression. Improper compression loss will be described with reference to FIGS. 3(*a*) and 3(*b*). FIG. 3 (*a*) shows inappropriate compression loss in the case of insufficient compression. FIG. 3 (*b*) shows inappropriate compression loss in the case of over-compression.

In the case of insufficient compression of FIG. 3(*a*), the volume of the second chamber reaches Vd and communicates, thereby the refrigerant therein is mixed with the refrigerant in the innermost chamber at high pressure Pd, the pressure thereby increases more steeply than the pattern of ideal compression Pid, and required power increases by the area of the shaded part. On the other hand, in the case of over-compression of FIG. 3(*b*), compression is continued after the pressure at the second chamber reaches high pressure Pd until the volume reaches Vd, and therefore the increase of power by the area of the shaded part is loss.

For the air-conditioning purpose, from the viewpoint of suppressing annual power consumption, performance improvement in low compression ratio operation under an intermediate condition besides under the rated condition in which relatively high compression ratio operation is performed is required, and the need for reducing the loss in over-compression is increasing. In scroll compressors, both the amount of insufficient compression loss and amount of over-compression loss relate to the speed at which the flow path between the second chamber and the innermost chamber expands just after the communication. Therefore, attention needs to be paid to the scroll wrap shape of the scroll inner end part, which influences this flow path formation.

The scroll inner end parts of the fixed scroll 11 and the orbiting scroll 12 have a so-called bulb shape. The bulb shape is such that the ends of involute curves are connected by two arcs of a small circle and a large circle, respectively. The involute curves thus forms a part of opposed inner and outer surfaces of each of the fixed scroll 11 and the orbiting scroll 12. Usually, a scroll inner end part is formed in one bulb shape having one set of dimensional specifics for one scroll wrap. However, the scroll inner end part of Embodiment 1 is formed in a stair-like shape in which a plurality of bulb shapes are stacked on top of one another in the upright direction of the scroll wrap (axial direction). Hereinafter, such a shape of the scroll inner end part may be referred to as a stair bulb shape.

Figure 4A:
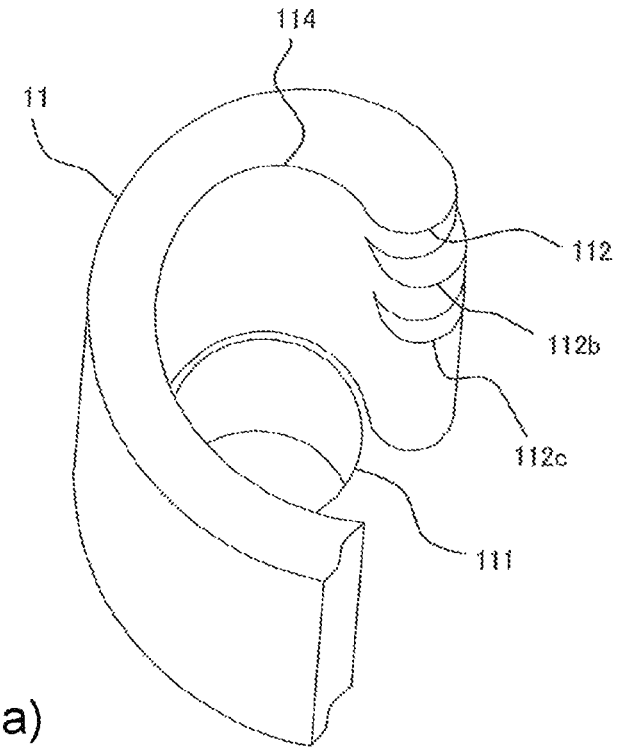
FIGS. 4(*a*) and 4(*b*) are enlarged perspective views showing the scroll inner end parts of the fixed scroll 11 and the orbiting scroll 12 in the scroll compressor 1 according to Embodiment 1 of the present invention.
Figure 4B:
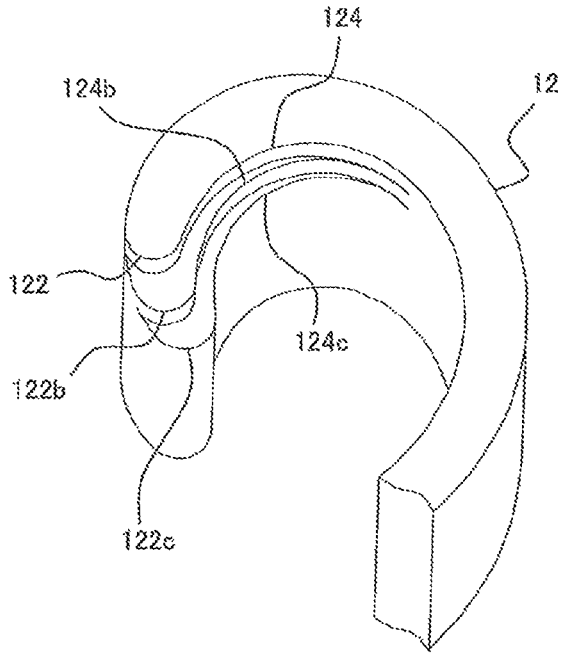
Figure 5A:
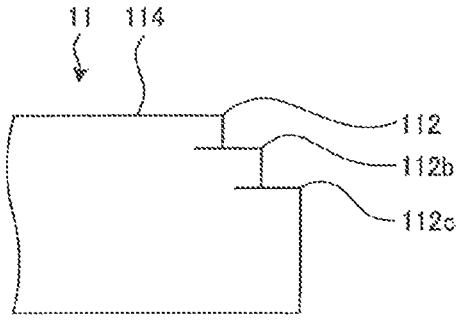
FIGS. 5(*a*) and 5(*b*) are schematic side surface shapes of the scroll inner end parts of the fixed scroll 11 and the orbiting scroll 12 in the scroll compressor 1 according to Embodiment 1 of the present invention as viewed from the inner peripheral side.
Figure 5B:
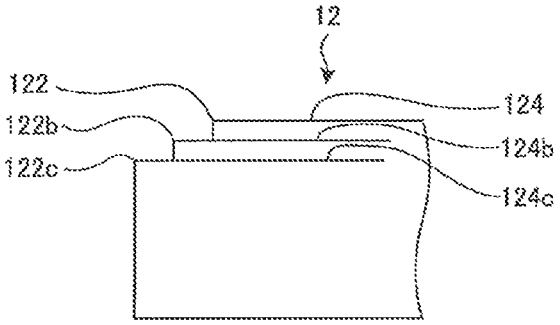
Figure 6A:
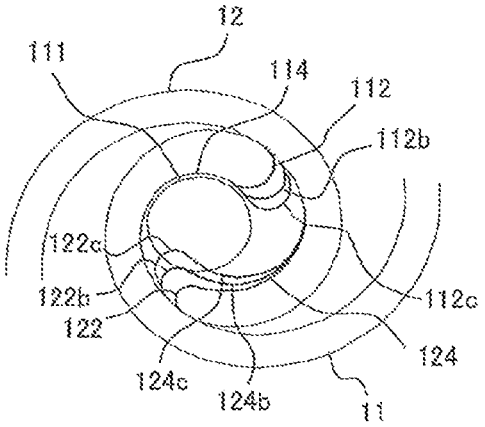
FIGS. 6(*a*), 6(*b*), 6(*c*), 6(*d*), 6(*e*) and 6(*f*) are enlarged plan views showing the scroll inner end parts of the fixed scroll 11 and the orbiting scroll 12 in the scroll compressor 1 according to Embodiment 1 of the present invention.
Figure 6B:
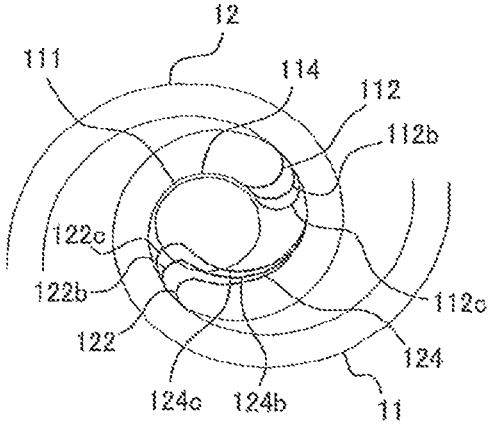
Figure 6C:
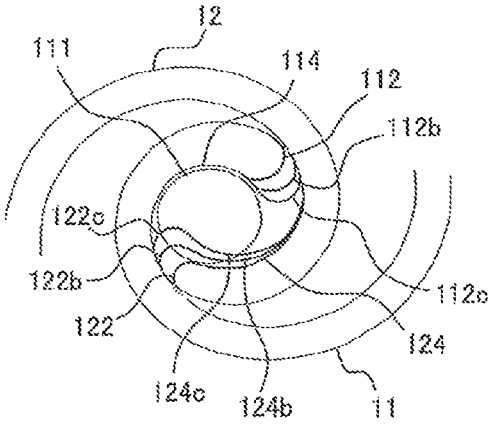
Figure 6D:
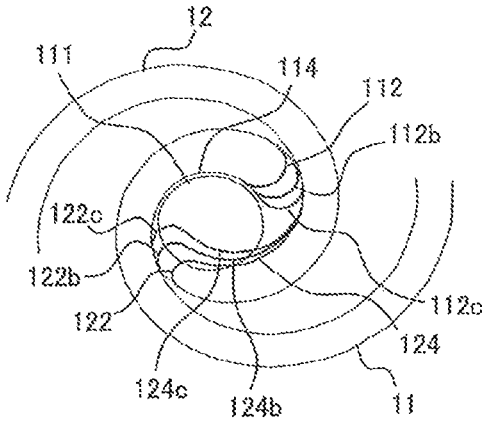
Figure 6E:
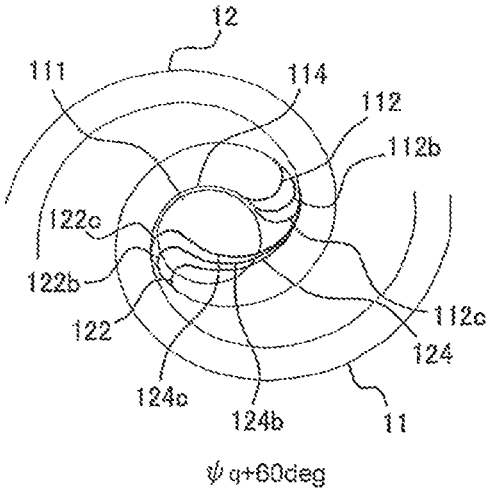
Figure 6F:
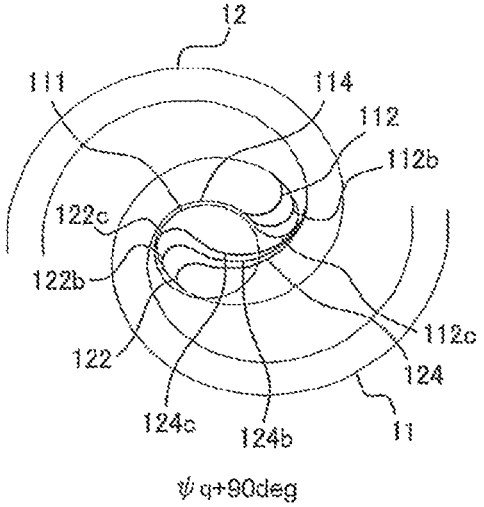

FIGS. 4(*a*) and 4(*b*) are enlarged perspective views showing the center parts of the scroll wraps (scroll inner end parts) of the fixed scroll 11 and the orbiting scroll 12. FIGS. 5(*a*) and 5(*b*) are views showing the schematic side surface shapes of the scroll inner end parts of the fixed scroll 11 and the orbiting scroll 12 as viewed from the inner peripheral side. FIG. 4 (*a*) and FIG. 5 (*a*) show the scroll inner end part of the fixed scroll 11 (scroll wrap 11*b*), and FIG. 4 (*b*) and FIG. 5 (*b*) show the scroll inner end part of the orbiting scroll 12 (scroll wrap 12*b*).

As shown in FIG. 4 (*a*) and FIG. 5 (*a*), the scroll inner end part of the scroll wrap of the fixed scroll 11 is formed, for example, in a three-tier stair-like shape, and the position of the small arc part is gradually shifted in the scroll inner end direction from the wrap tip end (above in the figure; the tip end of the wrap) toward the wrap root end (below in the figure; the root end of the wrap). The small arc part closest to the wrap tip end (upper tier) is a small arc part 112, the small arc part closer to the wrap root end than it (middle tier) is a small arc part 112*b*, and the small arc part closest to the wrap root end (lower tier) is a small arc part 112*c*. The small arc part 112*b* of the middle tier is disposed so as to be closer to the scroll inner end than the small arc part 112 of the upper tier, and the small arc part 112*c* of the lower tier is disposed so as to be closer to the scroll inner end than the small arc part 112*b* of the middle tier. Owing to such a configuration, the contact with the inner surface of the scroll wrap of the orbiting scroll 12 ends at different timings in the order of the upper tier, middle tier, and lower tier.

As shown in FIG. 4 (*b*) and FIG. 5 (*b*), as with the fixed scroll 11, the scroll inner end part of the scroll wrap of the orbiting scroll 12 is formed, for example, in a three-tier stair-like shape, and the position of the small arc part is gradually shifted in the winding start direction from the wrap tip end (above in the figure) toward the wrap root end (below in the figure). The small arc part (upper tier) closest to the wrap tip end is a small arc part 122, the small arc part (middle tier) closer to the wrap root end than the small arc part 122 is a small arc part 122*b*, and the small arc part (lower tier) closest to the wrap root end is a small arc part 122*c*. The small arc part 122*b* of the middle tier is disposed so as to be closer to the scroll inner end than the small arc part 122 of the upper tier, and the small arc part 122*c* of the lower tier is disposed so as to be closer to the scroll inner end than the small arc part 122*b* of the middle tier. Owing to such a configuration, the contact with the inner surface of the scroll wrap of the fixed scroll 11 ends at different timings in the order of the upper tier, middle tier, and lower tier.

Here, on the fixed scroll 11 side, the upper tier, middle tier, and lower tier are equal in the small circle radius and large circle radius, whereas on the orbiting scroll 12 side, the upper tier, middle tier, and lower tier differ in the small circle radius and large circle radius. For the small circle radius, the small circle radius of the small arc part 122 of the upper tier is the smallest, the small circle radius of the small arc part 122*b* of the middle tier is larger than the small arc part 122, and the small circle radius of the small arc part 122*c* of the lower tier is larger than the small arc part 122*b*. On the other hand, for the large circle radius, the large circle radius of the large arc part 124 of the upper tier is the largest, the large circle radius of the large arc part 124*b* of the middle tier is smaller than the large arc part 124, and the large circle radius of the large arc part 124*c* of the lower tier is smaller than the large arc part 124*b*. In the configuration of Embodiment 1, the upper tier, middle tier, and lower tier of the orbiting scroll 12 are equal in the involute roll angle of an inner surface involute curve (involute curve forming an inner surface of a scroll). In other words, the large circle radius in each tier of the orbiting scroll 12 varies according to the variation of the small circle radius.

FIGS. 6(*a*)-(*f*) are enlarged plan views showing the scroll inner end parts of the fixed scroll 11 and the orbiting scroll 12. The scroll wrap shapes of the fixed scroll 11 and the orbiting scroll 12 of the scroll compressor 1 will be described in detail with reference to FIGS. 6(*a*)-(*f*). FIG. 6 (*a*) shows a state where the second chamber communicates with the innermost chamber in the center (crank angle: ψq), FIG. 6 (*b*) shows a state where the orbiting scroll 12 has orbited 15 deg. after the communication (crank angle: ψq+15 deg.), FIG. 6 (*c*) shows a state where the orbiting scroll 12 has orbited 30 deg. after the communication (crank angle: ψq+30 deg.), FIG. 6 (*d*) shows a state where the orbiting scroll 12 has orbited 45 deg. after the communication (crank angle: ψq+45 deg.), FIG. 6 (*e*) shows a state where the orbiting scroll 12 has orbited 60 deg. after the communication (crank angle: ψq+60 deg.), and FIG. 6 (*f*) shows a state where the orbiting scroll 12 has orbited 90 deg. after the communication (crank angle: ψq+90 deg.).

In FIGS. 6 (*a*) to (*f*), the small arc parts of the scroll inner end part of the fixed scroll 11 are depicted as small arc parts 112, 112*b*, and 112*c*, and the large arc part of the scroll inner end part of the fixed scroll 11 is depicted as a large arc part 114. In FIGS. 6 (*a*) to (*f*), the small arc parts of the scroll inner end part of the orbiting scroll 12 are depicted as small arc parts 122, 122*b*, and 122*c*, and the large arc parts of the scroll inner end part of the orbiting scroll 12 are depicted as large arc parts 124, 124*b*, and 124*c*. In FIGS. 6 (*a*) to (*f*), in order to show the relationship between the respective tiers in a plan view, bulb shapes located at axially different positions are all shown by solid line. The same applies to FIGS. 2(*a*) to (*d*).

At the position of communication angle ψq shown in FIG. 6 (*a*), in the bulb part of the upper tier (on a tip side of the wrap or the wrap tip side) of each of the scroll wraps of the fixed scroll 11 and the orbiting scroll 12, the connection point between the small arc part 112, 122 and each outer surface involute curve (involute curve forming an outer surface of a scroll) is a seal forming point between the innermost chamber and the second chamber, and opening starts from this point. At the position of communication angle ψq shown in FIG. 6 (*a*), the connection points between the small arc parts other than that of the upper tier (small arc part 112*b*, 122*b* of the middle tier and small arc part 112*c*, 122*c* of the lower tier) and the outer surface involute curve are not yet seal forming points. As the crank angle progresses from FIG. 6(*b*) to FIG. 6(*c*) to FIG. 6(*d*), first, the connection point between the small arc part 112*b*, 122*b* of the middle tier and the outer surface involute curve opens, and then the connection point between the small arc part 112*c*, 122*c* of the lower tier and the outer surface involute curve opens. In Embodiment 1, a communication path is formed throughout the wrap height after 45 deg. of FIG. 6(*d*). In other words, in Embodiment 1, in the scroll wraps of the fixed scroll 11 and the orbiting scroll 12, the angles corresponding to the communication angles differ depending on the height (lap height).

Figure 7:
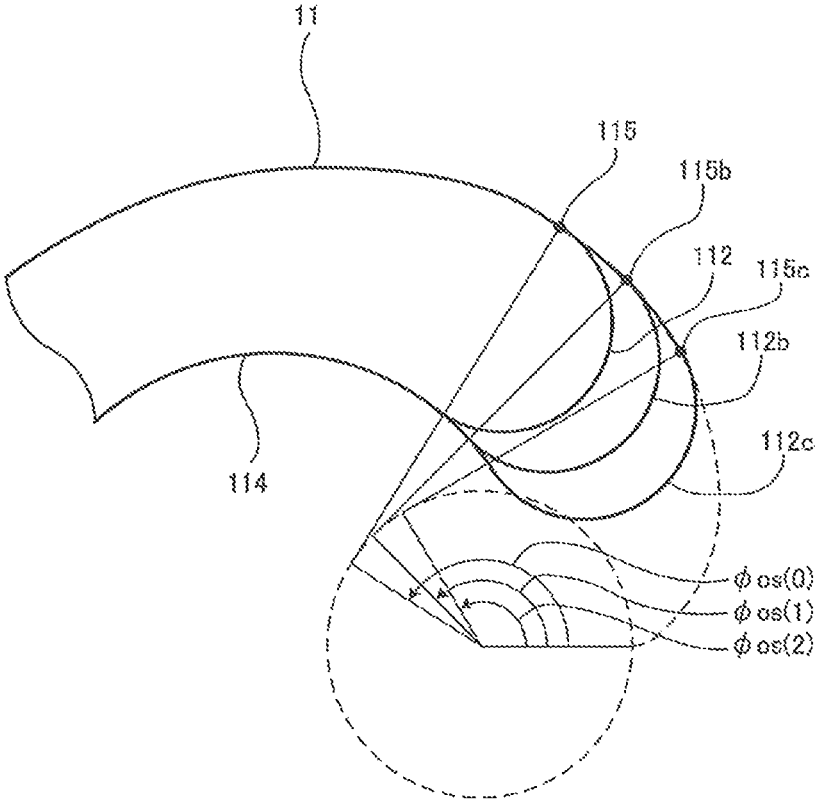
FIG. 7 is a further enlarged plan views showing the scroll inner end part of the fixed scroll 11 in the scroll compressor 1 according to Embodiment 1 of the present invention.

FIG. 7 is a further enlarged plan view showing the scroll inner end part of the fixed scroll 11. As shown in FIG. 7, the involute angle (involute roll angle) of the connection point between the small arc part 112 of the upper tier and the outer surface involute curve (involute curve end 115) is denoted by ϕos (0), the involute angle (involute roll angle) of the connection point between the small arc part 112*b* of the middle tier and the outer surface involute curve (involute curve end 115*b*) is denoted by ϕos (1), and the involute angle (involute roll angle) of the connection point between the small arc part 112*c* of the lower tier and the outer surface involute curve (involute curve end 115*c*) is denoted by ϕos (2). In this case, the involute roll angles of the respective tiers have the relationship of ϕos (0)>ϕos (1)>ϕos (2).

Although depiction is omitted, the center part of the scroll wrap of the orbiting scroll 12 has the same configuration as the fixed scroll 11 with respect to the involute roll angle of the outer surface involute curve. In other words, when the involute roll angle of the outer surface involute curve of the upper tier is denoted by ϕos (0), the involute roll angle of the outer surface involute curve of the middle tier is denoted by ϕos (1), and the involute roll angle of the outer surface involute curve of the lower tier is denoted by ϕos (2), ϕos (0)>ϕos (1)>ϕos (2).

Figure 8:
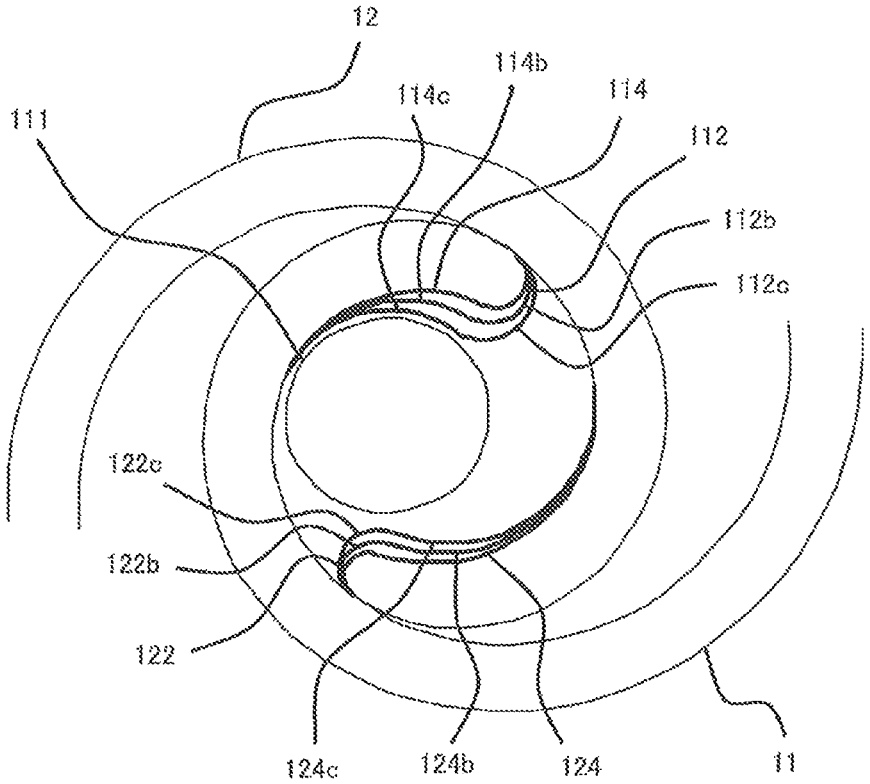
FIG. 8 is an enlarged plan view of an example of a configuration in which a stair-like bulb shape is formed as a reference example.

For comparison with the above configuration of Embodiment 1, an example of a configuration in which a stair-like bulb shape is formed is shown in FIG. 8 as a reference example. In the configuration of the scroll inner end part of the fixed scroll 11 shown in FIG. 8, the small circle radius of the small arc part 112*b* of the middle tier is larger than the small circle radius of the small arc part 112 of the upper tier, and the small circle radius of the small arc part 112*c* of the lower tier is larger than the small circle radius of the small arc part 112*b* of the middle tier. The large circle radius of the large arc part 114*b* of the middle tier is smaller than the large circle radius of the large arc part 114 of the upper tier, and the large circle radius of the large arc part 114*c* of the lower tier is smaller than the large circle radius of the large arc part 114*b* of the middle tier. The scroll inner end part of the orbiting scroll 12 has the same configuration as the scroll inner end part of the fixed scroll 11.

The configuration shown in FIG. 8 is the same as the configuration of Embodiment 1 in that the scroll inner end part is formed in a stair-like shape by placing a plurality of bulb shapes on top of one another in the axial direction. However, the respective tiers do not differ from Embodiment 1 in the position of the connection point between the small arc part 112, 112*b*, 112*c* in each tier and the outer surface involute curve, and the position of the connection point between the small arc part 122, 122*b*, 122*c* in each tier and the outer surface involute curve (the respective tiers are equal in involute roll angle). In other words, this example differs significantly in characteristic from Embodiment 1 in that the communication angle is the same regardless of the axial position.

Figure 9:
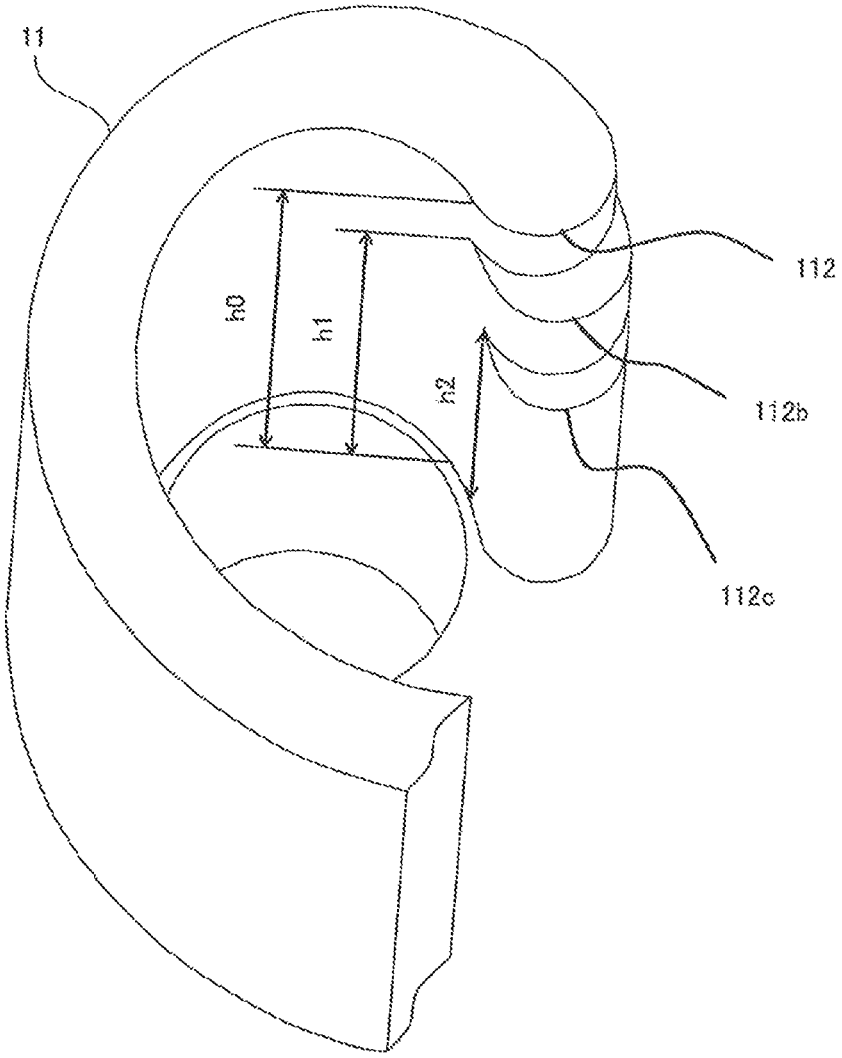
FIG. 9 is an explanatory diagram for defining the distribution of dimension in the wrap height direction among the respective tiers in the scroll compressor 1 according to Embodiment 1 of the present invention.

Next, in order to describe the opening characteristic after the communication in the stair-like bulb shape of Embodiment 1, the distribution of dimension in the wrap height direction among the respective tiers (height distribution) will be defined. FIG. 9 is an explanatory diagram for defining the distribution of dimension in the wrap height direction among the respective tiers. Here, assume a case where the bulb shape changes twice (the case of three tiers). As shown in FIG. 9, the total wrap height of the scroll wrap is denoted by h0, the height to the upper end face of the bulb shape due to the small arc part 112*b* (or 122*b*) of the middle tier is denoted by h1, and the height to the upper end face of the bulb shape due to the small arc part 112*c* (or 122*c*) of the lower tier is denoted by h2. Hereinafter, the height distribution of the stair bulb shape will be expressed by "x/y," where x=h1/h0, and y=h2/h0.

Figure 10A:
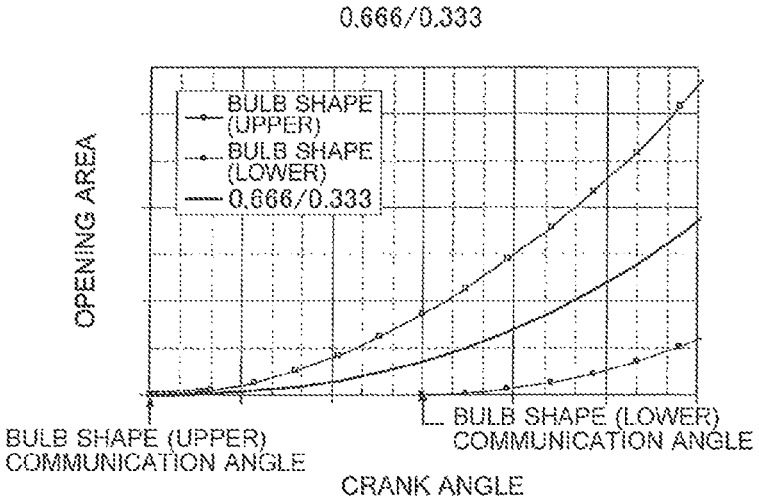
FIGS. 10(*a*). 10(*b*) and 10(*c*) are graphs showing the change of opening area of the communication path between the scroll wrap side surfaces when the height distribution of the stair bulb shape is changed in the scroll compressor 1 according to Embodiment 1 of the present invention.
Figure 10B:
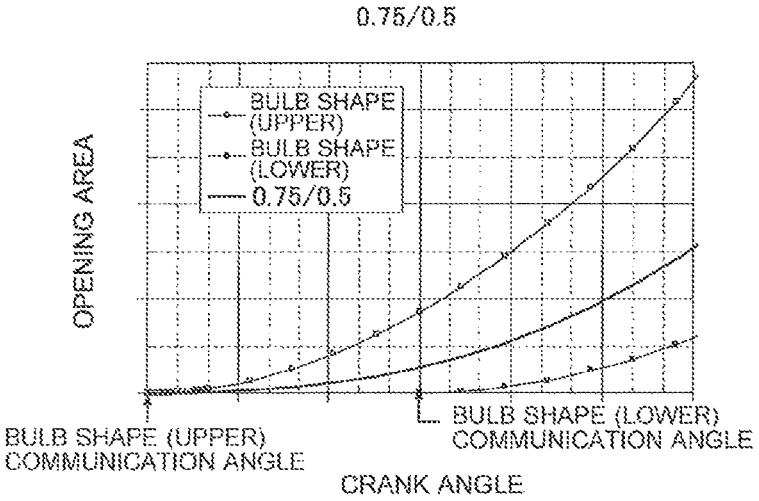
Figure 10C:
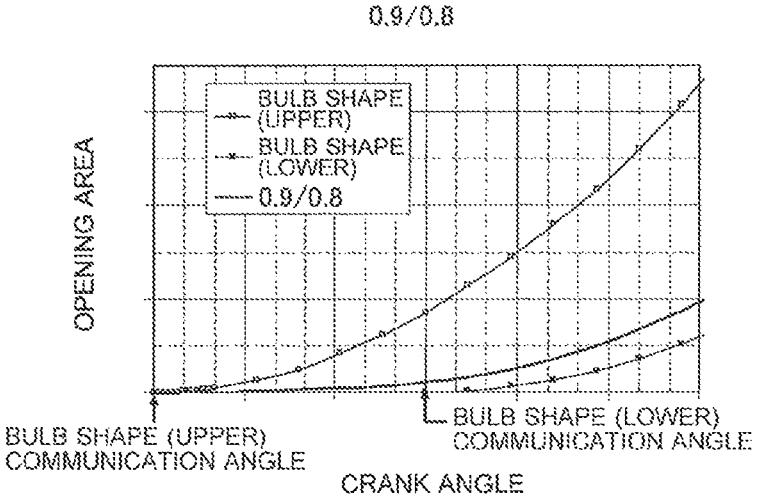

FIGS. 10(*a*) to 10(*c*), graphs showing the change of opening area of the communication path between the scroll wrap side surfaces when the height distribution of the stair bulb shape is changed. FIG. 10 (*a*) shows a case where the height distribution is 0.666/0.333, FIG. 10 (*b*) shows a case where the height distribution is 0.75/0.5, and FIG. 10 (*c*) shows a case where the height distribution is 0.9/0.8. In each of FIGS. 10(*a*) to 10(*c*), the change of opening area in the case of the bulb shape due to the small arc part 112, 122 of the upper tier throughout the wrap height direction of the scroll wrap ("bulb (upper)") and the change of opening area in the case of the bulb shape due to the small arc part 112, 122 of the lower tier throughout the wrap height direction of the scroll wrap ("bulb (lower)") are plotted together.

As shown in FIGS. 10 (*a*) to 10(*c*), the opening characteristic of the stair bulb is an opening characteristic intermediate between the "bulb (upper)" and "bulb (lower)." The opening characteristic in the case of 0.666/0.333 in which the height distribution among the respective tiers is equal (FIG. 10 (*a*)) is a characteristic that is just the average of the "bulb (upper)" and "bulb (lower)." As the distribution ratios of the middle tier and lower tier are increased from 0.75/0.5 to 0.9/0./8 (FIG. 10 (*b*), FIG. 10(*c*)), the opening characteristic gradually approaches the characteristic of the "bulb (lower)."

Figure 11:
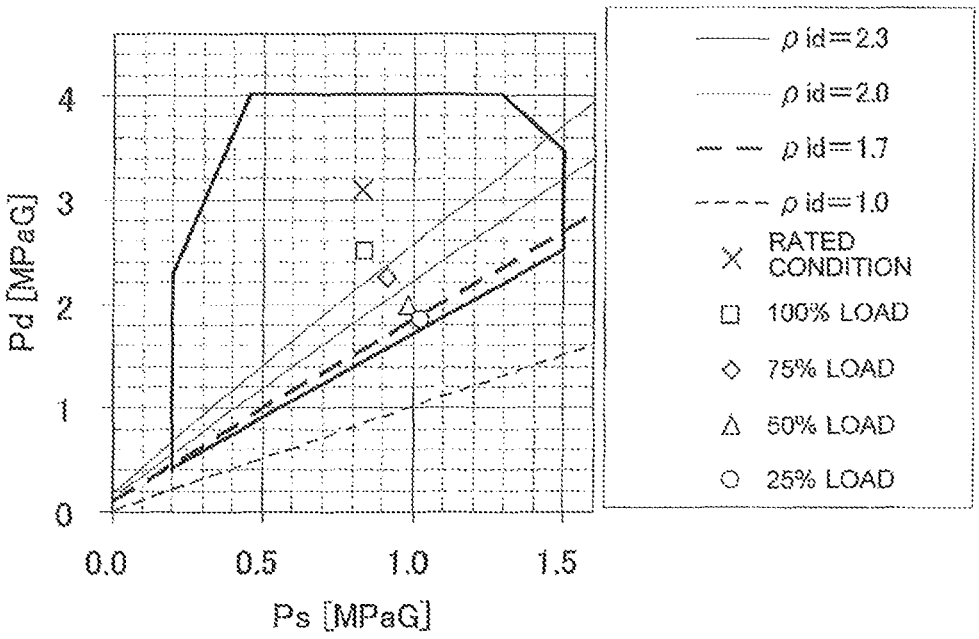
FIG. 11 is an operation map showing an example of partial load performance evaluation condition.

FIG. 11 shows an example of performance evaluation condition under partial load on a map with high pressure Pd as the ordinate and low pressure Ps as the abscissa. As for the part-load performance emphasized in air conditioners in recent years, the lower the load factor is such that the lower compression ratio the operating condition is. In the case of 25% load, the condition is a volume ratio ρid of 1.7 or less, and operation corresponding to proper compression at which neither over-compression nor insufficient compression is caused is performed. On the other hand, under the rated condition, the volume ratio ρid exceeds 3. The operating rotation speed also changes depending on the pressure condition. In general, scroll compressors tend to be operated at low speed under the condition of a low compression ratio, and at high speed when the compression ratio is high.

For the use in such a wide compression ratio, if partial load performance is emphasized and ρid is set low, the above-described insufficient compression loss (FIG. 3 (*a*)) is caused under an operating condition of a relatively high compression ratio, such as the rated condition. On the other hand, if ρid is set relatively high in consideration of the rated condition side, over-compression loss (FIG. 3 (*b*)) is caused at the time of low compression ratio operation under partial load condition. For this reason, performance degradation under the condition on the high compression ratio side or low compression ratio side cannot be avoided.

In order to reduce over-compression loss under the low compression ratio condition from the viewpoint of internal volume ratio ρ, the innermost chamber and the second chamber is brought into communication when fluid is compressed to a compression ratio as close as possible to ρid of the low compression ratio condition. As described above, the lower the compression ratio is, the lower the operating rotation speed tends to be, and therefore the speed at which the opening area expands may be slow.

On the other hand, in order to reduce insufficient compression loss under the high compression ratio condition in which the scroll compressor is operated at relatively high rotating speed, it is preferable that the innermost chamber and the second chamber do not communicate with each other until ρid of the high compression ratio condition is approached, or it is preferable that, even if the innermost chamber and the second chamber communicate with each other, the opening area does not increase rapidly. After compression proceeds close to ρid of the high compression ratio condition, compression proceeds in a short time because of relatively high rotation speed, and therefore, it is preferable that the speed at which the opening area expands increase.

When adjusting the opening speed of the scroll wrap side surfaces of the innermost chamber/second chamber by height distribution among the respective tiers, it is preferable to adjust the stair bulb shape such that the bulb (upper) communication angle shown in FIGS. 10(*a*) to 10(*c*) corresponds to ρid under the low compression ratio condition, and the bulb (lower) communication angle is brought as close as possible to ρid under the high compression ratio condition. This makes it possible to obtain a preferable communication pattern in which the opening speed is low in the low compression ratio range, and the opening speed increases in the high compression ratio range.

Figure 12A:
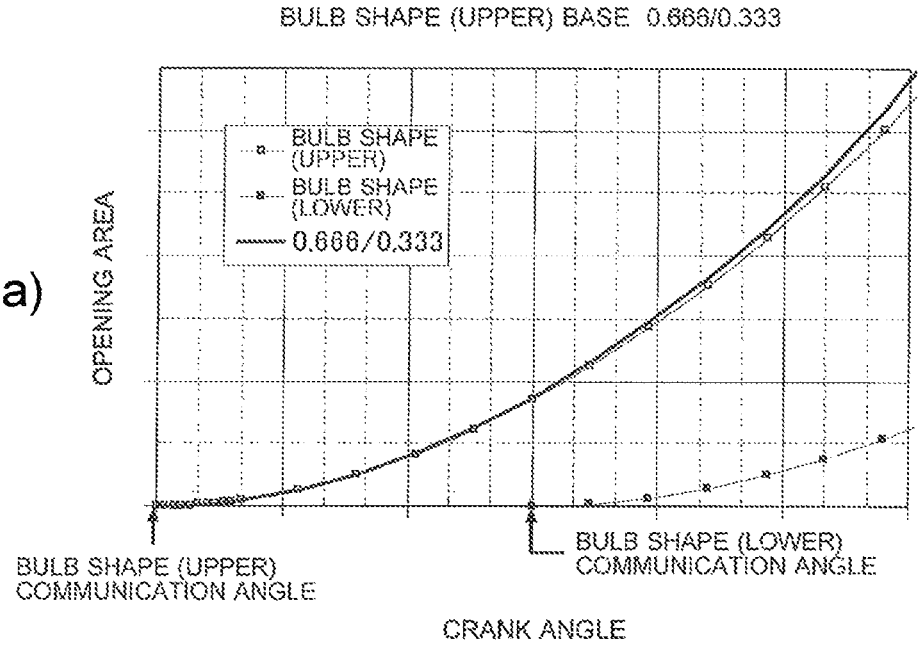
FIGS. 12(*a*) and 12(*b*) are graphs showing the change of opening area when the height distribution is 0.666/0.333 in the stair bulb shape of the reference example.
Figure 12B:
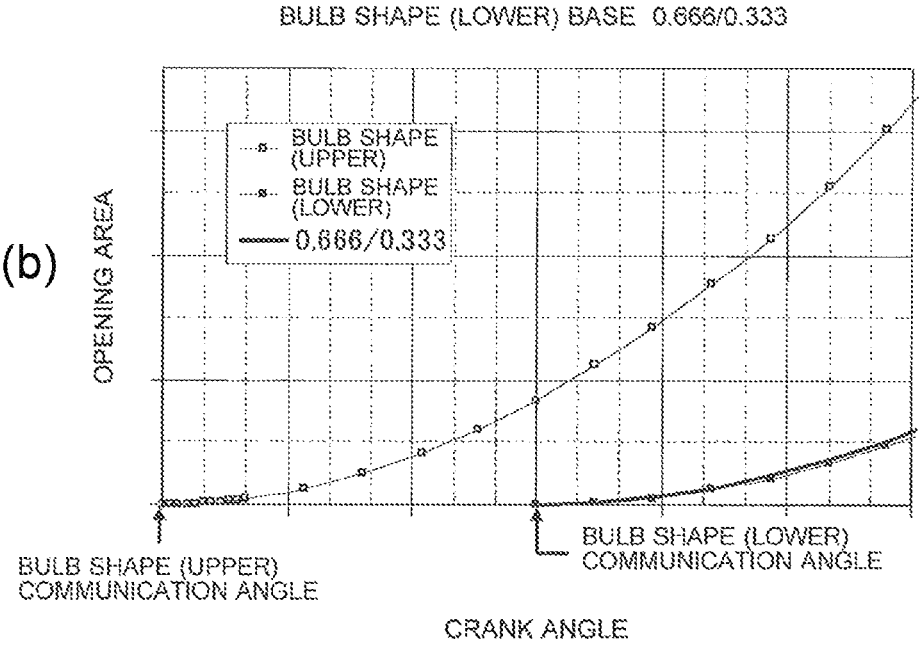

By contrast, in the case of the stair bulb shape of the reference example shown in FIG. 8, the opening speed cannot be adjusted so as to respond to wide range of operating conditions. FIGS. 12(*a*) and 12(*b*) are graphs showing the change of opening area when the height distribution is 0.666/0.333 in the stair bulb shape of the reference example shown in FIG. 8. FIG. 12 (*a*) shows a case where a stair bulb (the plan shape of FIG. 8) is formed based on the bulb shape of the small arc part 112, 122 of the upper tier (bulb (upper) base), and FIG. 12 (*b*) shows a case where a stair bulb is formed based on the bulb shape of the small arc part 112*c*, 122*c* of the lower tier (bulb (lower) base). In both FIG. 12 (*a*) and FIG. 12(*b*), the opening area is merely increased slightly compared to the base bulb shape, and it can be seen that a significant effect cannot be expected on the reduction of inappropriate compression loss due to the change of compression ratio.

In other words, as in Embodiment 1, by forming the scroll inner end part of the scroll wrap in a stair-like shape in which a plurality of bulb shapes that differ in the involute roll angle of the outer surface involute curve are stacked on top of one another in the upright direction of the scroll wrap, an opening area increase pattern at the time of communication that can respond to the change of compression ratio can be obtained. This makes it possible to obtain a scroll compressor that is highly efficient and low-power-consumption in both the rated condition and partial load condition.

Here, in Embodiment 1, an orbiting scroll 12 in which the respective tiers do not differ in the involute roll angle of the inner surface involute curve, and the large circle radius in each tier is changed according to the small circle radius, and a fixed scroll 11 in which the respective tiers are equal in the involute roll angle of the inner surface involute curve, the large circle radius, and the small circle radius are combined. The fact that the fixed scroll 11 may have such a shape that forms the scroll inner end part of the scroll wrap in a stair bulb shape and varying the wrap thickness from tier to tier are not inseparable (are independent) from each other.

Figure 13:
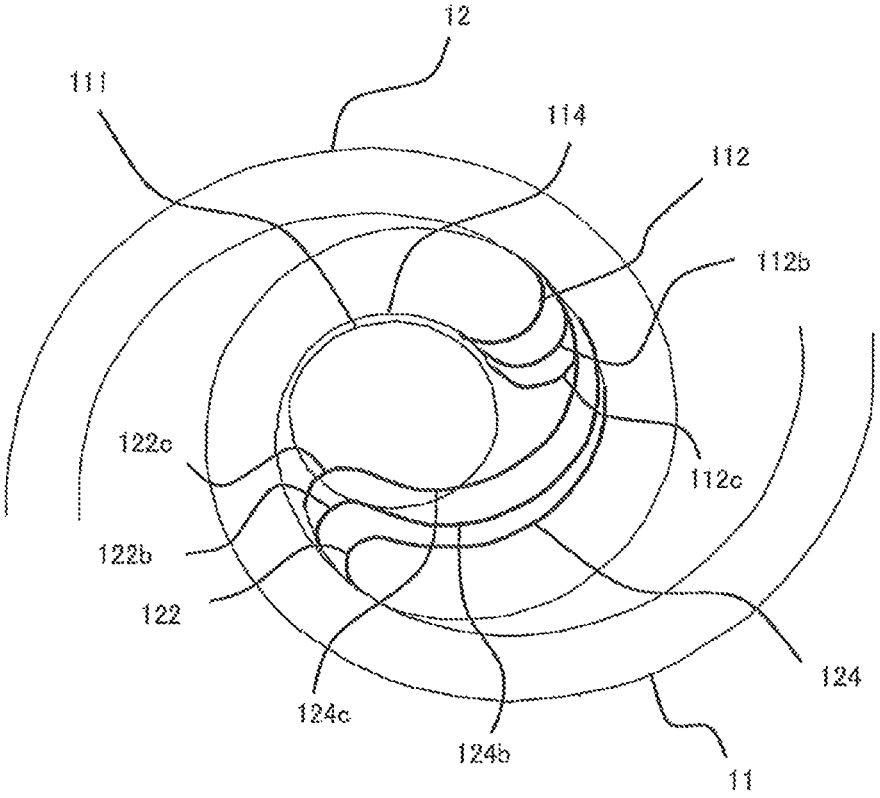
FIG. 13 is a plan view showing a modification of the configuration of the scroll inner end part of the scroll wrap in the scroll compressor 1 according to Embodiment 1 of the present invention.

FIG. 13 is a plan view showing a modification of the configuration of the scroll inner end part of the scroll wrap in Embodiment 1. In the configuration shown in FIG. 13, in the scroll inner end part of the orbiting scroll 12, the respective tiers differ in the involute roll angle of the inner surface involute curve besides the large circle radius and the small circle radius. Thus, in the scroll inner end part of the orbiting scroll 12 (or the fixed scroll 11), the respective tiers may differ in the involute roll angle of the inner surface involute curve, the large circle radius, and the small circle radius. In any case, the advantageous effect of Embodiment 1 related to the opening speed adjustment at the time of communication can be obtained by forming a stair bulb shape in which the respective tiers differ in the involute roll angle of the outer surface involute curve.

As described above, the scroll compressor according to Embodiment 1 is a scroll compressor 1 that compresses fluid in a compression chamber 4 formed by combining a scroll wrap 11*b* of a fixed scroll 11 and a scroll wrap 12*b* of an orbiting scroll 12. The scroll wrap 11*b* of the fixed scroll 11 and the scroll wrap 12*b* of the orbiting scroll 12 each have a scroll inner end part having a bulb shape in which an end of an outer surface involute curve and an end of an inner surface involute curve are connected by a plurality of arcs. At least one of the scroll inner end parts is formed in an n-tier stair-like shape in which n (n 3) bulb shapes are stacked on top of one another in an upright direction of the scroll wrap. The scroll compressor is configured to satisfy $\phi os(0)>\phi os(1)>\phi os(2)>\ldots>\phi os(n-1)$ where involute roll angles of the outer surface involute curve in respective tiers of the scroll inner end part formed in a stair-like shape are $\phi os(0), \phi os(1), \phi os(2), \ldots, \phi os(n-1)$ respectively, from a wrap tip side (the tip side of the wrap) to a wrap root side (the root side of the wrap).

According to this configuration, the speed at which the communication path opens after the communication angle ψq between the innermost chamber and the second chamber determined by the involute roll angle of the outer surface involute curve in the uppermost tier can be adjusted over a wide range by the distribution of height dimension among the respective tiers. This makes it possible to obtain a highly efficient scroll compressor in which the effect of inappropriate compression loss can be reduced under a wide operating condition from a low compression ratio to a high compression ratio.

In the scroll compressor according to Embodiment 1, the scroll inner end part has a bulb shape having a small arc part connected to the end of the outer surface involute curve, and a large arc part interposed between the small arc part and the end of the outer surface involute curve and having a radius larger than that of the small arc part, and the radius of the small arc part in each tier of the scroll inner end part formed in a stair-like shape decreases toward the wrap tip side (see, for example, FIG. 4 (*b*)).

In the scroll compressor according to Embodiment 1, the scroll inner end part has a bulb shape having a small arc part connected to the end of the outer surface involute curve, and a large arc part interposed between the small arc part and the end of the outer surface involute curve and having a radius larger than that of the small arc part, and the radii of the small arc parts in tiers of the scroll inner end part formed in a stair-like shape are same as each other (see, for example, FIG. 4 (*a*)).

OTHER EMBODIMENTS

The present invention is not limited to the above-described Embodiment 1, and various changes may be made.

For example, although in the above-described Embodiment 1, the scroll inner end part of the scroll wrap is formed in a three-tier stair-like shape, the scroll inner end part of the scroll wrap may be formed in a four or more tier stair-like shape.

Although in FIG. 4(*a*), FIG. 4(*b*), FIG. 5(*a*), and FIG. 5(*b*), the height distribution among the respective tiers differs between the fixed scroll 11 and the orbiting scroll 12, needless to say, the height distribution among the respective tiers of the fixed scroll 11 and the orbiting scroll 12 may be the same.

Although in the above-described Embodiment 1, both the fixed scroll 11 and the orbiting scroll 12 have stair-like scroll inner end parts, only one of the fixed scroll 11 and the orbiting scroll 12 may have a stair-like scroll inner end part.

The above-described embodiments and modifications may be implemented in combination with each other.

REFERENCE SIGNS LIST

1 scroll compressor 4 compression chamber 11 fixed scroll 11*a* end plate 11*b* scroll wrap 12 orbiting scroll 12*a* end plate 12*b* scroll wrap 13 Oldham ring 14 frame 14*a* suction port 15 shaft 16 first balancer 17 second balancer 18 rotor 19 stator 20 sub-bearing 21 airtight container 22 lubricating oil 23 suction pipe 24 discharge pipe 25 discharge valve 26 sub-frame 111 discharge port 112, 112*b*, 112*c* small arc part 114, 114*b*, 114*c* large arc part 115, 115*b*, 115*c* end 121 boss portion 122, 122*b*, 122*c* small arc part 124, 124*b*, 124*c* large arc part 151 eccentric portion.

The invention claimed is:

1. A scroll compressor to compress fluid in a compression chamber formed by a fixed scroll and an orbiting scroll, wherein at least one of the fixed scroll and the orbiting scroll has a scroll wrap that includes a scroll inner end part having a bulb shape defined by an outer surface involute curve, an inner surface involute curve, and a plurality of arcs connecting an end of the outer surface involute curve and an end of the inner surface involute curve, the scroll inner end part is formed in a tiered shape in which a number n of bulb-shaped tiers are stacked on top of one another in an axial direction of the compressor, where the number n is equal to or larger than 3, the scroll compressor is configured to satisfy $$\phi os(0)>\phi os(1)>\phi os(2)> \ldots >\phi os(n-1)$$

where involute roll angles of the end of the outer surface involute curve in the tiers of the scroll inner end part are $\phi os(0)$, $\phi os(1)$, $\phi os(2)$, . . . , $\phi os(n-1)$, respectively, from a wrap tip side to a wrap root side.

2. The scroll compressor of claim 1, wherein each tier of the scroll inner end part has a small arc part and a large arc part, the small arc part being connected to the end of the outer surface involute curve, the large arc part being interposed between the small arc part and the end of the inner surface involute curve and having a radius larger than a radius of the small arc part, and the tiers of the scroll inner end part in one of the fixed scroll and the orbiting scroll are stacked on one another toward the wrap tip side in a descending order of a magnitude of the radius of the small arc part.

3. The scroll compressor of claim 2, wherein the small arc parts of the tiers of the scroll inner end part in the other one of the fixed scroll and the orbiting scroll have the same radii.

4. A scroll compressor to compress fluid in a compression chamber formed by a fixed scroll and an orbiting scroll, wherein each of the fixed scroll and the orbiting scroll has a scroll wrap that includes a scroll inner end part having a bulb shape defined by an outer surface involute curve, an inner surface involute curve, and a plurality of arcs connecting an end of the outer surface involute curve and an end of the inner surface involute curve, each of the scroll inner end parts is formed in a tiered shape in which a number n of bulb-shaped tiers are stacked on top of one another in an axial direction of the compressor, where the number n is equal to or larger than 3, the scroll compressor is configured to satisfy $$\phi os(0)>\phi os(1)>\phi os(2)> \ldots >\phi os(n-1)$$

where involute roll angles of the end of the outer surface involute curve in the tiers of the scroll inner end part are $\phi os(0)$, $\phi os(1)$, $\phi os(2)$, . . . , $\phi os(n-1)$, respectively, from a wrap tip side to a wrap root side.

5. The scroll compressor of claim 4, wherein each tier of each scroll inner end part has a small arc part and a large arc part, the small arc part being connected to the end of the outer surface involute curve, the large arc part being interposed between the small arc part and the end of the inner surface involute curve and having a radius larger than a radius of the small arc part, and on the fixed scroll, the small arc parts of the tiers of the scroll inner end part have the same radii.

* * * * *